United States Patent [19]

Audette et al.

[11] 3,944,960

[45] Mar. 16, 1976

[54] NONRESETTABLE THERMALLY ACTUATED SWITCH

[75] Inventors: Richard T. Audette, Attleboro; Frederick G. Perry, Norton, both of Mass.

[73] Assignee: Texas Instruments Incorporated, Dallas, Tex.

[22] Filed: Nov. 29, 1974

[21] Appl. No.: 527,979

[52] U.S. Cl. ..... 337/408; 337/409

[51] Int. Cl.[2] ..... H01H 37/76

[58] Field of Search ..... 337/403, 404, 405, 407, 337/408, 409

[56] References Cited

UNITED STATES PATENTS

| | | | |
|---|---|---|---|
| 3,727,164 | 4/1973 | Cartier et al. | 337/409 X |
| 3,781,737 | 12/1973 | Henry | 337/407 |
| 3,820,050 | 6/1974 | Tyler et al. | 337/408 |

FOREIGN PATENTS OR APPLICATIONS

| | | | |
|---|---|---|---|
| 1,164,589 | 9/1969 | United Kingdom | 337/409 |

*Primary Examiner*—G. Harris

*Attorney, Agent, or Firm*—James P. McAndrews; John A. Haug; Russell E. Baumann

[57] ABSTRACT

A nonresettable thermally actuated switch comprising a case of electrically conductive material, a first power lead connected to the case, a second power lead electrically insulated from the case, a deformable connector of conductive material in electrical contact with an inside surface of the case and with the second lead thereby to complete a circuit. The switch further includes an insulator biased toward the connector by a spring but separated therefrom by a body of fusible material. When heated above a predetermined temperature the fusible material melts and the insulating member moves against the connector mechanically deforming the connector away from the inside surface of the case and electrically insulating the connector from the case thereby to break the circuit.

14 Claims, 3 Drawing Figures

NONRESETTABLE THERMALLY ACTUATED SWITCH

BACKGROUND OF THE INVENTION

This invention relates to a thermally actuated switch, and more particularly to a one-time or nonresettable thermally actuated switch.

Generally, such one-time switches are used to protect a motor, transformer, or other electrical apparatus from operating in ambient temperatures which exceed a predetermined maximum safe level. Such one-shot switches are typically used as back-up devices for protecting electrical apparatus which may also have current sensing devices or other thermostatic switches or the like adapted to provide normal overload protection for the apparatus, the switch of this invention functioning where the normally relied upon devices might fail. For example, such a switch may be serially connected to the windings of a motor so as to protect the motor by interrupting the power supplied thereto in the event that, because of overheating of the motor winding or for any other reason, the ambient temperature to which the switch is exposed exceeds a level which could cause damage to the motor. These switches are often relatively small (e.g., 0.50 inches or 1.27 cm. long and 0.135 inches or 0.34 cm. in diameter) so they may be readily incorporated in the apparatus they are to protect so as to be responsive to the ambient temperatures to which the apparatus is exposed and to be responsive to any abnormal rise in temperature the apparatus might undergo due to overload or short circuit conditions in the apparatus.

More particularly, such switches utilize a fusible material which rapidly undergoes a change of state when heated to a predetermined temperature (i.e., the fusible material melts) to effect breaking of the circuit. Reference may be made to such U.S. Pat. Nos. as 3,180,958, 3,291,945, 3,309,481, 3,505,630 and 3,519,972 for such one time thermally actuated switches.

SUMMARY OF THE INVENTION

Among the several objects of this invention may be noted the provision of a one-time thermally actuatable switch which effects a more positive interruption of an electrical circuit upon the switch being heated above a predetermined temperature; the provision of such a switch which has a minimum number of parts, which is convenient and inexpensive to manufacture, and which is reliable in operation. Other objects and features of this invention will be in part apparent and in part pointed out hereinafter.

Briefly, a nonresettable thermally actuated switch of this invention comprises a case of electrically conductive material, a first power lead electrically connected to the case, a second power lead electrically insulated from the case, and a deformable connector of conductive material in electrical contact with an inside surface of the case and with the second lead thereby to complete a circuit. Means is provided actuable in response to being heated above a predetermined temperature for deforming the connector means away from the inside surface of the case and for electrically insulating the connector from the case thereby to break the circuit.

BRIEF DESCRIPTION OF THE DRAWINGS

Corresponding reference characters indicate corresponding parts throughout the several views of the drawings.

BRIEF DESCRIPTION OF A PREFERRED EMBODIMENT

Figure 1:
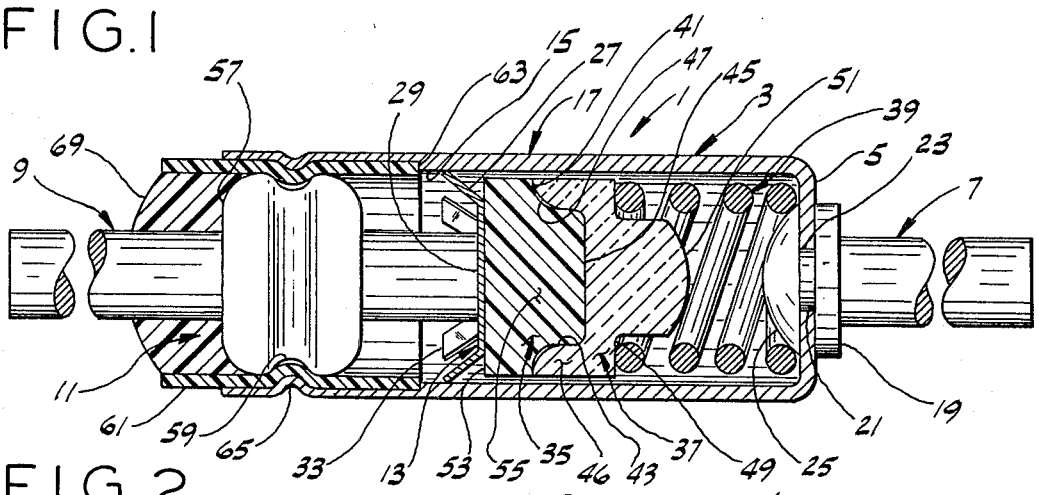
FIG. 1 is an enlarged longitudinal section of the switch of this invention showing it in its operating position in which the current is carried from one power lead through the case to a connector and to another power lead.

Referring now to the drawings and more particularly to FIG. 1, a nonresettable (or one-time) thermally actuated switch of this invention, generally indicated at 1, is shown to comprise a cylindric case or housing 3 of electrically conductive material, such as formed from silver-plated red brass or the like. One end of the case is closed, as indicated at 5, and a first power lead or terminal 7 is secured in electrical contact with the closed end 5 of the case. A second power lead 9 is electrically insulated from the case and secured thereto by insulator and securement means 11. This second lead extends into an open end of the housing opposite closed end 5. A deformable connector 13 of electrically conductive material, such as silver sheet material or the like, is normally in electrical contact with an inside surface 15 of case 3 and in electrical contact with the inner end of lead 9. As generally indicated at 17, means are provided which are actuable in response to being heated above a predetermined ambient temperature for deforming (i.e., bending) connector 13 away from inside surface 15 of case 3 and for electrically insulating the connector from the case thereby to break the circuit.

More particularly, lead 7 is shown to have a flange 19 adjacent its end and a short portion 21 extending beyond the flange insertable through an opening 23 in end 5 of case 3. Once inserted through opening 23, portion 21 is upset, as indicated at 25, with flange 19 abutting end 5 of the case so as to positively secure the lead to the case in electrical contact therewith.

Figure 3:
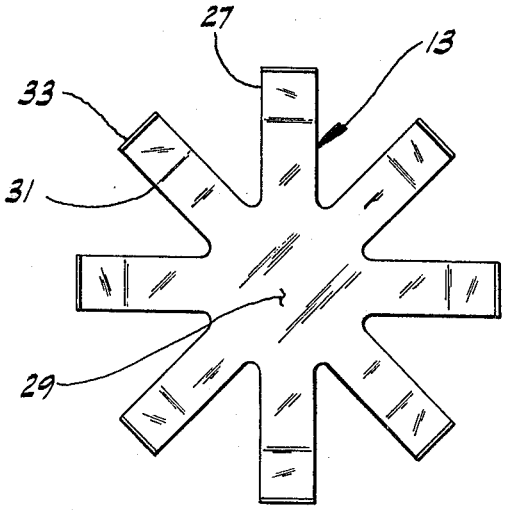
FIG. 3 is an enlarged end elevational view illustrating the deformable connector.

Connector 13, as best shown in FIG. 3, is a star-shaped contact member having 8 bendable legs or contact portions 27 and a center portion 29. The legs are each bent, as indicated at 31, from the plane of the center portion so that only the outer peripheral edges 33 of the legs contact the inner surface 15 of case 3 thereby to provide electrical contact between the case and connector 13. The center portion 29 of connector 13 is adapted to bear against the inner end of power lead 9 thereby to complete the circuit between case 5 and lead 9. As the span of connector 13 between opposed outer edges 33 is somewhat greater than the inside dimensions of case 3 and as its legs 27 are resilient, its legs bend inwardly upon being inserted in the case and thus are resiliently biased into contact with inside wall 15 of case 3 to provide good electrical contact between the case and the connector. While connector 13 is shown as star-shaped to provide readily deformable legs, it will be understood that connectors of other configurations, such as a cup-shaped, radially slotted connector may be used.

Means 17 for deforming connector 13 is shown to comprise a solid body 35 of fusible material engageable with the center portion 29 of the connector, an insulator 37, and a spring 39. The fusible material is preferably an organic compound such as a petroleum wax compound or the like which upon being heated to a predetermined temperature rapidly changes state from a solid to a liquid. Insulator 37 is spaced from connetor 13 by the fusible member while the fusible member is in its solid preformed shape (i.e., before it melts). Insulator 37 has an edge 41 engageable with connector 13 for deforming the connector (i.e., for bending legs 27 of the connector) so as to break electrical contact between the legs and the inside surface of the case. Spring 39 is a compression coil spring interposed between end 5 of case 3 and the inner end of insulator 37 to bias the insulator, the fusible member, and connector 13 into positive current-carrying engagement with the inner end of lead 9, this inner end of lead constituting an abutment for connector 13. Insulator 37 is a generally cylindric cup-shaped member having outer dimensions somewhat less than those of the inside of case 3 so that it is freely movable longitudinally within the case from a retracted position (see FIG. 1) in which the fusible material maintains it spaced from connector 13 and an advanced circuit-breaking position (see FIG. 2) in which its edge 41 engages connecctor 13 and deforms the latter to break the circuit. Insulator 37 is movable from its retracted position (see FIG. 1) to its circuit-breaking position by spring 39 upon fusible member 35 melting. It will be understood that with the insulator in its retracted position, coil spring 39 is compressed in a preloaded position and contains sufficient stored energy to move the insulator forward and to deform legs 27 of connector 13 and to break the circuit.

Insulator 37 has a central bore or recess 43 having a base wall 45 at its inner end facing fusible member 35, cylindric side walls 46, and a rounded transition surface 47 between edge 41 and the side walls. The insulator also has a shoulder 49 against which one end of spring 39 bears and a central hub portion 51 extending into the coil spring.

Fusible wax body 35, like insulator 37 is cylindric and has a generally flat face 53 engageable with portion 29 of connector 13 and a central hub portion 55 extending into recess 43 of the insulator and bearing against base wall 45 thereof.

Insulator and securement means 11 comprises an integral collar 57 formed on lead 9 and spaced from the inner end of the lead. Collar 57 is of substantially larger diameter than lead 9 but is somewhat smaller than the inner diameter of the open end of case 3 and has a circumferential groove 59 therearound. Means 11 further comprises a sleeve 61 of a flexible electrical insulator material, such as may be formed from a polyimide resin available commercially from E. I. DuPont de Nemours and Company under the trademark KAPTON. The outer diameter of sleeve 61 is only slightly less than the inner diameter of the open end of case 3 so as to be conveniently insertable into the open end of case 3 and be disposed between the case and the outer surface of the collar. An inwardly projecting shoulder 63 within case 3 is engageable with the inner end of the sleeve upon inserting the sleeve in the case and thus serves as a locating stop for the sleeve. Lead 9 with collar 57 thereon is inserted axially endwise into sleeve 61 until the inner end of terminal 9 is positioned within the case, such as is shown in FIG. 1. The outer end of the case and sleeve 61 are crimped, as indiated at 65, into groove 59 of collar 57 thereby to positively secure and to electrically insulate lead 9 relative to the case. It will be understood that with terminal 9 secured within case 3 as above described, the inner end of lead 9 serves as an abutment for connector 13 and the preload compression force of spring 39 is reacted against the case via insulator 37, wax member 35, connector 13, lead 9 and collar 57.

Figure 2:
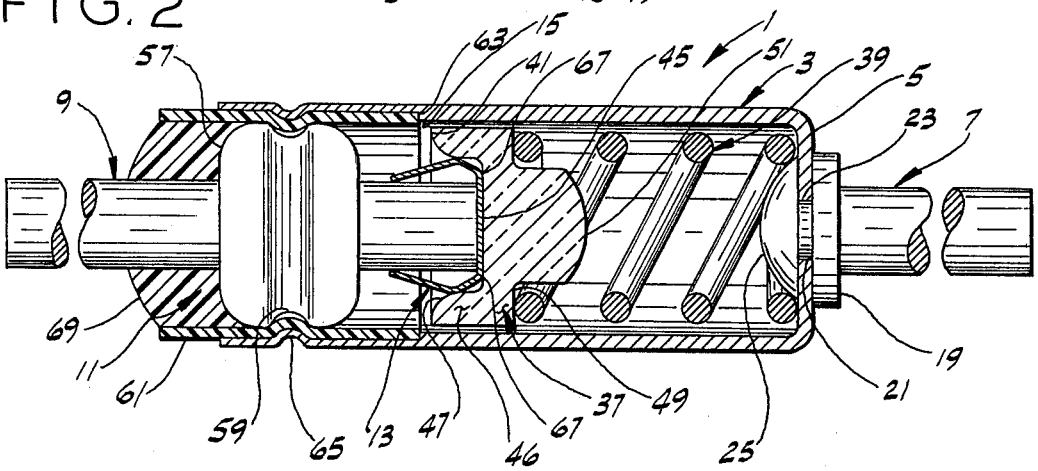
FIG. 2 is a view similar to FIG. 1 showing the connector deformed away from the case thereby breaking the circuit.

Upon switch 1 being heated above a predetermined ambient temperature level, thermal sensing member 35 melts and thus permits spring 39 to rapidly move insulator member 37 from its retracted to its circuit-breaking position. As insulator 37 moves forward, its leading edge 41 engages legs 27 of connector 13 and forces the connector to bend at a point 67, as indicated in FIG. 2, thereby to move the outer edges 33 of the connector away from the inner face 15 of case 3. Upon continued further movement of insulator member 37 by spring 39, the transition portion 47 of the insulator member cammingly engages the connector and causes edges 33 to further move away from the inner surface 15 of the case (i.e., to move radially inwardly toward lead 9). Base wall 45 of the insulator is engageable with portion 29 of the connector and thus provides a hard stop for the insulator. With the insulator in its circuit-breaking position, a portion of the insulator is interposed between the connector and the inside surface 15 of the case thereby to positively insulate the connector and lead 9 from the case. It will be understood that when the thermal sensing member 35 melts, the melted wax will merely pool (not shown in FIG. 2) in the lower portion of case 3 and does not prohibit insulator 37 from moving from its retracted to its circuit-breaking position. It will further be understood that the fusible material is not electrically conductive.

In assembling a nonresettable thermally actuated switch 1 of this invention, spring 39, insulator 37, wax body 35 and connector 13 are inserted in the above specified order into the open end of case 3, such as shown in FIG. 1. Sleeve 61 is inserted into the open end of the case until its forward end engages shoulder 63. Lead 9 with collar 57 thereon is inserted into the open end of the case through sleeve 61 until the forward end of the lead engages the back face of connector 13. Lead 9 is then further pushed into the case thereby to compress spring 39 to its preloaded condition (as shown in FIG. 1) so as to positively maintain connector 13 in current-carrying relation with the inner end of lead 9. Case 3 is then crimped at 65 thereby to positively lock lead 9 in position within the open end of the case may be sealed with a conventional molded in place potting compound, as indicated at 69.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A nonresettable thermally actuated switch comprising a case of electrically conductive material, a power lead means electrically insulated from the case, deformable connector means of electrically conductive material in electrical contact with an inside surface of said case and with said lead means thereby to complete a circuit, an electrically insulating member movable for deforming said connector means away from said inside surface of said case and for electrically insulating said connector means from said case thereby to break said circuit, means resiliently biasing said insulating member for movement to deform said connector means away from said inside case surface, and a normally solid body of material fusible at a selected temperature disposed within said case to prevent said insulating member movement while said body is solid and to permit said insulating member movement when said body is heated to said selected temperature.

2. A nonresettable thermally actuated switch comprising a case of electrically conductive material, a power lead means electrically insulated from the case, deformable connector means of conductive material in electrical contact with an inside surface of said case and with said lead means thereby to complete a circuit, said deformable connector means having an outer surface engageable with said inside surface of said case and a center portion engageable with said lead means, an insulating member of rigid insulating material having a portion adapted to engage said connector means for deforming said connector means away from said inside surface of said case and for electrically insulating said connector means from said case thereby to break said circuit, means resiliently biasing said insulating member toward said connector means for deforming said connector means away from said inside case surface, and a solid body of material fusible at a selected temperature disposed between said insulating member and said connector means normally spacing said deforming portion of said insulating means relative to said connector means, said body being fusible at a selected temperature for permitting said resilient biasing means to move said deforming portion of said insulating member into engagement with said connector means to deform said connector means away from said inside surface of said case and to electrically insulate said connector means from said case.

3. A nonresettable thermally actuated switch comprising a case of electrically conductive material, a first power lead electrically connected to the case, a second power lead electrically insulated from the case, deformable connector means of conductive material in electrical contact with an inside surface of said case and with said second lead thereby to complete a circuit, and means actuable in response to being heated above a predetermined temperature for deforming said connector means away from said inside surface of said case and for electrically insulating said connector means from said case thereby to break said circuit, said deformable connector means having an outer surface engageable with said inside surface of said case and a center portion engageable with said second lead, said deforming and insulating means comprising a body of fusible material engaging the center portion of said connector means, an insulating member of rigid insulating material having an edge adapted to engage said connector means, and means resiliently biasing said body of fusible material via said insulating member into engagement with said connector means to hold the latter in positive current-carrying engagement with said second lead, said body of fusible material being adapted to melt upon being heated above the predetermined temperature thereby to permit movement of said insulating member under the bias of said biasing means from a retracted position in which it is clear of said connector means to a circuit-breaking position in which it deforms said connector means away from said inside surface of the housing thereby to break said circuit.

4. A switch as set forth in claim 3 wherein said connector means comprises a contact member of bendable, conductive material, having a plurality of deformable contact portions extending outwardly from said center portion with an edge of each said contact portion constituting said surface engageable with said inside surface of said case, said contact portions being resiliently biased generally outwardly toward said inside surface of said case whereby said edges are in current-carrying engagement with said inside surface of the case.

5. A switch as set forth in claim 3 wherein said case is circular in cross secion and one end thereof is closed, said first lead being secured to said closed end of said case in electrical contact therewith.

6. A switch as set forth in claim 5 wherein said biasing means is a compression coil spring interposed between said closed end of said case and said insulating member, said spring having sufficient stored energy to move said insulating member from its retracted to its circuit-breaking position upon said fusible member melting.

7. A switch as set forth in claim 6 wherein said second lead extends axially into the other end of said case, the inner end of said second lead constituting an abutment engageable by the center portion of said connector means, and wherein said second lead includes means for insulating it from said case and for securing it in position relative to said case so as to react the force of said spring against said case.

8. A switch as set forth in claim 7 wherein said insulating and securing means comprises a member of increased diameter on said second lead spaced from the inner end thereof, said member being substantially the same diameter as the inside dimensions of said case, said case being deformed to engage said member thereby to prevent movement of said member and said second lead out of said case.

9. A switch as set forth in claim 8 wherein said insulating and securing means further comprises flexible insulating means disposed between the outer periphery of the member of increased diameter and said case thereby to electrically insulate said member from said case.

10. A switch as set forth in claim 9 wherein said insulating means comprises a sleeve of flexible insulating material, said sleeve being deformed along with said case for engagement with said member thereby to secure said member and said second lead relative to the case.

11. A switch as set forth in claim 10 wherein said case has an inwardly projecting shoulder constituting a stop for said sleeve, said stop being engageable by said sleeve thereby to prevent movement thereof into said case beyond a predetermined position within said case.

12. A switch as set forth in claim 11 wherein said increased diameter member has an annular groove on its outer peripheral surface, said sleeve and said case being deformed into said groove thereby to positively hold said second lead in position within said case.

13. A switch as set forth in claim 4 wherein said insulating member has a bore in its face toward said connector and a rounded transition surface between said edge and said bore engageable with said connector means, said rounded transition surface being cammingly engageable with said connector as said insulating member moves from its retracted position toward its circuit breaking position so as to bend said contact portions of said connector inwardly toward said second lead clear of the wall of said case.

14. A switch as set forth in claim 13 wherein said insulating member has a cylindric wall with its inner surface constituting said bore and with its edge toward said connector means constituting said edge engageable with said connector means, said cylindric wall being positioned between said connector means and said case when said insulating member is in its circuit breaking position thereby to positively insulate said connector means from said case.

* * * * *